US009033734B2

(12) United States Patent
Tanaka et al.

(10) Patent No.: US 9,033,734 B2
(45) Date of Patent: May 19, 2015

(54) CONNECTOR

(75) Inventors: Masahiro Tanaka, Makinohara (JP); Hajime Kato, Makinohara (JP)

(73) Assignee: Yazaki Corporation, Tokyo (JP)

( * ) Notice: Subject to any disclaimer, the term of this patent is extended or adjusted under 35 U.S.C. 154(b) by 167 days.

(21) Appl. No.: 13/636,234

(22) PCT Filed: Jan. 16, 2012

(86) PCT No.: PCT/JP2012/050755

§ 371 (c)(1),
(2), (4) Date: Sep. 20, 2012

(87) PCT Pub. No.: WO2012/099075

PCT Pub. Date: Jul. 26, 2012

(65) Prior Publication Data

US 2013/0017719 A1 Jan. 17, 2013

(30) Foreign Application Priority Data

Jan. 21, 2011 (JP) ..... 2011-010742

(51) Int. Cl.
*H01R 13/40* (2006.01)
*H01R 9/03* (2006.01)
*H01R 13/52* (2006.01)
(Continued)

(52) U.S. Cl.
CPC ..... *H01R 9/032* (2013.01); *H01R 13/521* (2013.01); *H01R 13/5845* (2013.01); *H01R 13/6592* (2013.01)

(58) Field of Classification Search
CPC ..... H01R 13/5208; H01R 13/521; H01R 13/5202; H01R 13/5221
USPC ..... 439/587, 589, 271–273, 281–281
See application file for complete search history.

(56) References Cited

U.S. PATENT DOCUMENTS 4,643,506 A * 2/1987 Kobler ..... 439/271
5,540,450 A * 7/1996 Hayashi et al. ..... 277/607
(Continued)

FOREIGN PATENT DOCUMENTS

CN 1551455 A 12/2004
CN 1619906 A 5/2005
(Continued)

OTHER PUBLICATIONS

International Search Report for PCT/JP2012/050755 dated Apr. 10, 2012 [PCT/ISA/210].
(Continued)

*Primary Examiner* — Xuong Chung Trans
(74) *Attorney, Agent, or Firm* — Sughrue Mion, PLLC

(57) ABSTRACT

There is provided a connector capable of reliably preventing a short circuit without causing increase in cost. The connector includes a terminal which is joined to an electric wire, a housing which accommodates a terminal joint part which is a joint portion of the electric wire and the terminal, a sealing member which is made of a resilient material having waterproof and insulation properties to seal between the housing and the terminal joint part, and a shield member which covers the housing and the electric wire near the terminal joint part, wherein the sealing member is formed integrally with an electric wire protecting part which extends along the electric wire to cover the electric wire, and the electric wire protecting part is interposed between the electric wire and the shield member.

2 Claims, 6 Drawing Sheets

(51) Int. Cl.
*H01R 13/58* (2006.01)
*H01R 13/6592* (2011.01)

(56) References Cited

U.S. PATENT DOCUMENTS

| | | | | |
|---|---|---|---|---|
| 6,039,603 | A * | 3/2000 | Wakata et al. | 439/587 |
| 6,680,433 | B2 * | 1/2004 | Hashizawa et al. | 174/359 |
| 6,814,617 | B2 * | 11/2004 | Oota et al. | 439/589 |
| 6,815,610 | B2 | 11/2004 | Kuboshima et al. | |
| 7,202,804 | B2 * | 4/2007 | Nakagaki et al. | 341/118 |
| 8,393,911 | B2 * | 3/2013 | Aoki et al. | 439/272 |
| 2004/0057187 | A1 | 3/2004 | Kuboshima et al. | |
| 2004/0229508 | A1 | 11/2004 | Miyazaki et al. | |
| 2005/0142942 | A1 | 6/2005 | Hayashi | |
| 2005/0282438 | A1 | 12/2005 | Wada | |

FOREIGN PATENT DOCUMENTS

| | | | |
|---|---|---|---|
| DE | 101 40 685 | C1 | 3/2003 |
| DE | 10 2005 056 328 | A1 | 5/2007 |
| JP | 2002-289307 | A | 10/2002 |
| JP | 2002-313496 | A | 10/2002 |
| JP | 2003272729 | A | 9/2003 |
| JP | 2003297472 | A | 10/2003 |
| JP | 2004-119047 | A | 4/2004 |
| JP | 2005-011645 | A | 1/2005 |
| JP | 2006-004755 | A | 1/2006 |
| JP | 201238450 | A | 2/2012 |

OTHER PUBLICATIONS

Office Action, dated Jun. 30, 2014, issued by The State Intellectually Property Office of the People's Republic of China in counterpart Patent Application No. 201280001172.X.

Extended European Search Report, dated Apr. 28, 2014, issued by the European Patent Office in counterpart European Patent Application No. 12736540.1.

Written Opinion for PCT/JP2012/050755 dated Apr. 10, 2012 [PCT/ISA/237].

Japanese Office Action dated Sep. 17, 2014 issued by Japanese Patent Office in counterpart Japanese Patent Application No. 2011-010742.

Communication dated Feb. 11, 2015 issued by The State Intellectual Property Office of the People's Republic of China in counterpart Chinese Application No. 201280001172.X.

* cited by examiner

CONNECTOR

TECHNICAL FIELD

The present invention relates to a connector including a housing for accommodating terminals which are joined to electric wires therein, and a shield shell for covering the housing.

BACKGROUND ART

A well-known type of connector is one which includes a housing for accommodating terminal fittings which are connected to electric wires, a metallic shield shell provided on the housing, a metallic tubular connecting member for connecting a terminal portion of a shield member, which covers the electric wires together, and the shield shell and also surrounding the electric wires, and an insulating electric wire cover provided between the tubular connecting member and the electric wires (see Patent Document 1).

PRIOR ART DOCUMENT

Patent Documents

Patent Document 1: Japanese Patent Application Publication No. 2006-4755A

SUMMARY OF INVENTION

Problems to be Solved by Invention

However, if the electric wire is stretched by an external force, for example, shock applied from an exterior, the electric wire can be ruptured at a joint portion of the electric wire and the terminal. Otherwise, if a sheath of the electric cable is peeled off, the electric wire can be short-circuited from the shield shell.

The connector is configured to avoid a conductor of the electric wire and the tubular connecting member from being brought in electrical contact with each other by providing an insulating electric wire cover between the tubular connecting member and the electric wire. However, since the separate electric wire cover molded from rubber or resin is required, the number of components is increased, and thus this causes increase in cost. Also, in the case of using the electric wire cover made of resin, the electric wire cover is ruptured by the external force such as shock, so that a reliable short circuit preventing effect may not be obtained.

The present invention has been made in view of the above-described problem, and an object of the present invention is to provide a connector capable of reliably preventing a short circuit without causing increase in cost.

Means for Solving Problems

In order to accomplish the above-described object, a connector according to the present invention is characterized by (1) and (2) below.

(1) A connector including: a terminal which is joined to an electric wire; a housing which accommodates a terminal joint part which is a joint portion of the electric wire and the terminal; a sealing member which is made of a resilient material having waterproof and insulation properties to seal between the housing and the terminal joint part; and a shield member which covers the housing and the electric wire near the terminal joint part, wherein the sealing member is formed integrally with an electric wire protecting part which extends along the electric wire to cover the electric wire, and wherein the electric wire protecting part is interposed between the electric wire and the shield member.

(2) In the connector as described in (1), wherein the sealing member has a mold part for molding the terminal joint part, and the electric wire protecting part is molded integrally with the mold part.

In the connector including the configuration of (1), it can reliably prevent a short circuit which is caused by contact between the electric wire and the shield member, since the electric wire near the terminal joint part is covered and protected by the electric wire protecting part of the sealing member having an insulation property, and the electric wire protecting part is interposed between the electric wire and the shield member.

Further, since the electric wire protecting part for preventing the short circuit is formed as a portion of the sealing member, as compared to the case of forming and employing a separate protecting member, it does not increase the number of components, which increases in cost.

Furthermore, since the electric wire protecting part is made of a resilient material, as compared to the case in which an electric wire protecting part is made of hard resin, it is possible to prevent the electric wire without being damaged by an external force, such as shock, from an exterior, thereby reliably obtaining the effect of preventing the short circuit.

In addition, only the electric wire protecting part extends from the sealing member, and thus the number of components is not increased. Therefore, since it is not necessary to change manufacturing steps and man-hours when manufacturing, particular equipment can be easily provided at the time of production.

In the connector including the configuration of (2), since the electric wire protecting part is molded integrally with the sealing part, it is possible to reliably prevent the short circuit, without causing increase in cost.

Advantageous Effects of Invention

With the present invention, the connector can be provided to reliably prevent the short circuit, without causing increase in cost.

As described above, the present invention has been briefly described. A detail of the present will be apparent by reading the best mode for carrying out invention as explained later with reference to accompanying drawings.

MODE TO CARRY OUT INVENTION

Embodiments of the present invention will now be described with reference to the accompanying drawings.

First Embodiment

First, a connector according to the first embodiment will be described.

Figure 1:
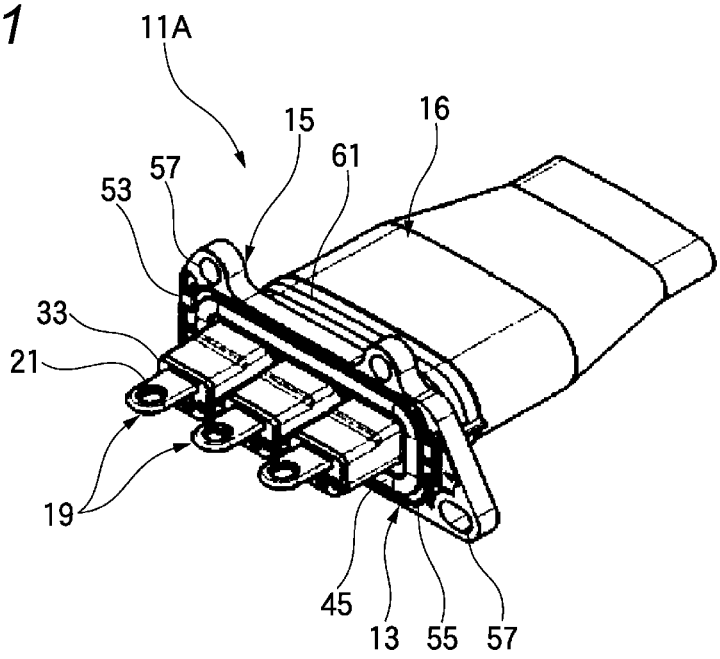
FIG. 1 is a perspective view illustrating a connector according to a first embodiment of the present invention.
Figure 2:
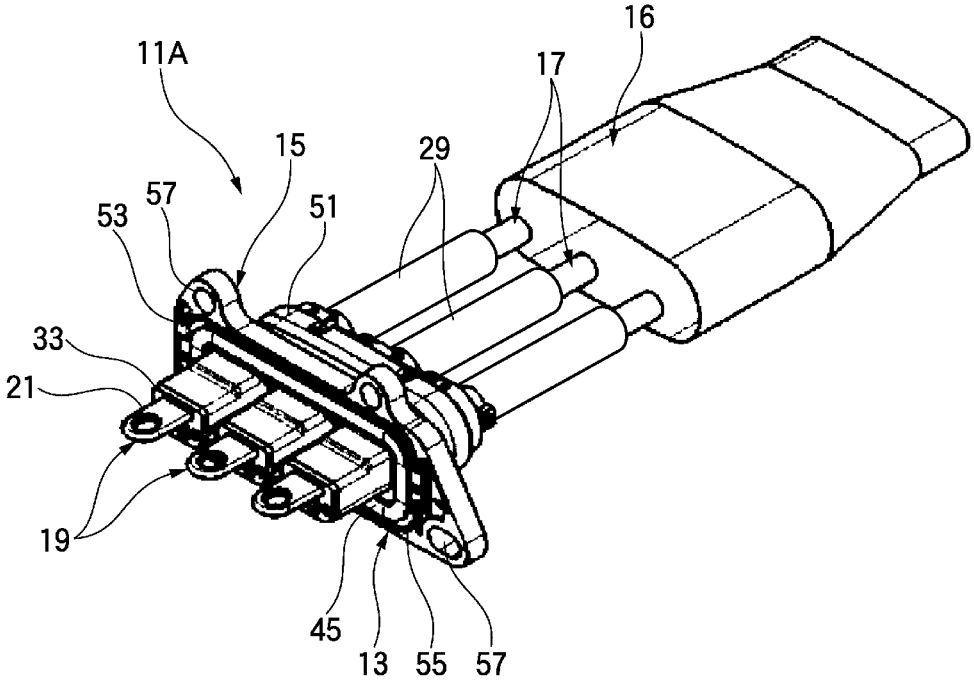
FIG. 2 is an exploded perspective view illustrating the connector according to the first embodiment of the present invention.
Figure 3:
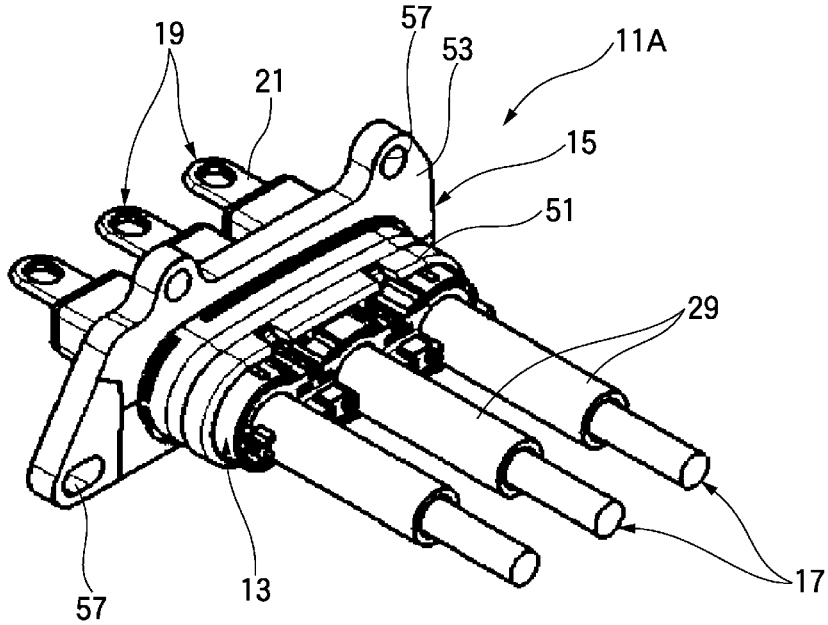
FIG. 3 is a perspective view illustrating the connector according to the first embodiment of the present invention, when seen from a rear side, in the state in which a shield member is detached.
Figure 4:
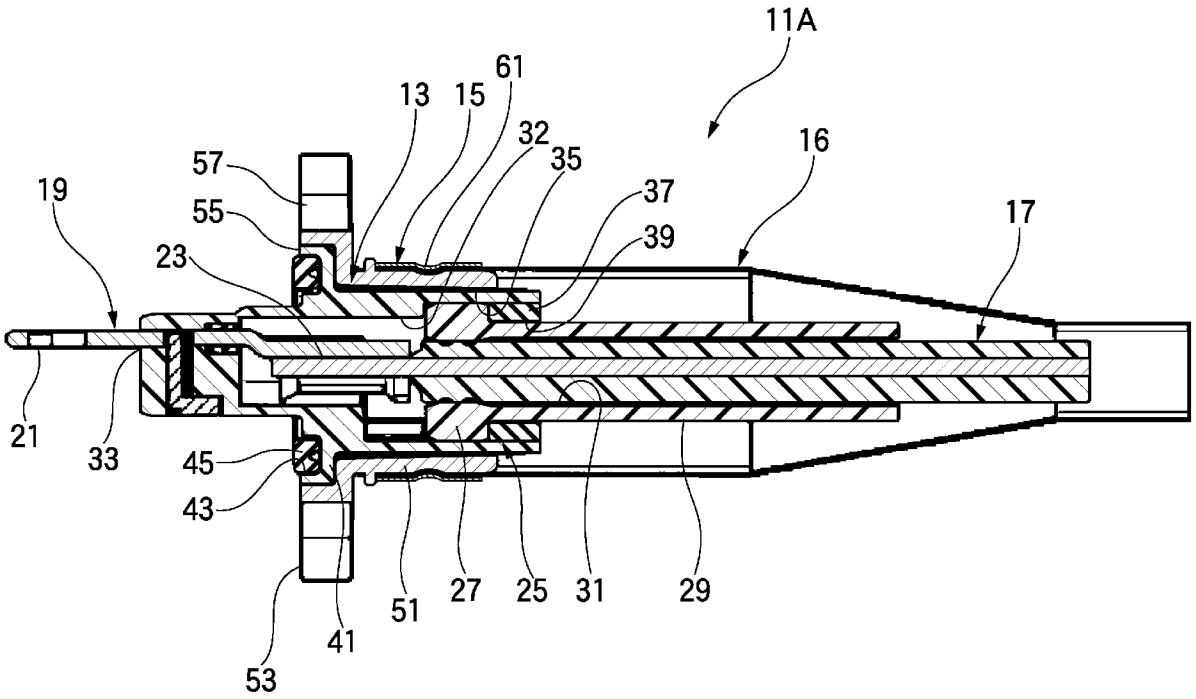
FIG. 4 is a cross-sectional view illustrating the connector according to the first embodiment of the present invention.
Figure 5:
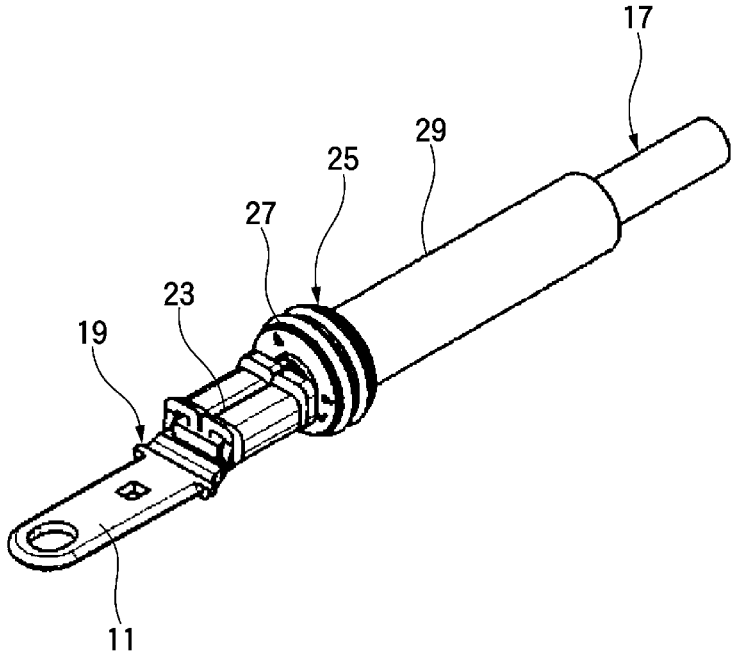
FIG. 5 is a perspective view illustrating an end portion of an electric wire which is connected to the connector.

FIG. 1 is a perspective view illustrating the connector according to the first embodiment of the present invention. FIG. 2 is an exploded perspective view illustrating the connector according to the first embodiment of the present invention. FIG. 3 is a perspective view illustrating the connector according to the first embodiment of the present invention, when seen from a rear side, in the state in which a shield member is detached. FIG. 4 is a cross-sectional view illustrating the connector according to the first embodiment of the present invention. FIG. 5 is a perspective view illustrating an end portion of an electric wire which is connected to the connector.

As illustrated in FIGS. 1 to 4, a connector 11A according to the first embodiment is, for example, a motor connector which is directly attached to a motor for HEV (hybrid electric vehicle), and includes a housing 13 made of, for example, resin having an insulation property. A shield shell 15 is mounted on the housing 13, and a shield member 16 is attached to a rear side of the housing.

The housing 13 accommodates terminals 19 attached to end portions of a plurality of electric wires 17.

Each electric wire 17 is to supply electric power to the motor, and is one including a conductor made of metal, for example, copper, and a sheath made of an insulator, for example, resin, which encloses an outer circumference of the conductor. The end portion of the electric wire 17 is provided integrally with the terminal 19 which is directly connected to a terminal of the motor or the like.

As illustrated in FIG. 5, the terminal 19 has a tap 21 and a terminal joint part 23, and the conductor of the electric wire 17 which is exposed from the sheath is press-fixed to the terminal joint part 23 of the terminal 19. A method of fixing the conductor of the electric wire 17 to the terminal joint part 23 may include thermal compression bonding, ultrasonic joining, and pressure welding.

The electric wire 17 is provided with a sealing member 25. The sealing member 25 is made of waterproof resin consisting of elastomer (elastic material) having insulation and waterproof properties, for example, rubber. The sealing member has a sealing portion 27 formed in a ring shape, and an electric wire protecting part 29 of a tubular shape extending from the sealing portion 27 to one side. The sealing member 25 has a hole portion 31 at its center, through which the electric wire 17 passes. As the electric wire 17 passes through the hole portion 31 of the sealing member 27, the sealing member 25 is mounted on the electric wire 17 so that the sealing portion 27 is disposed at the terminal 19 side and the electric wire protecting part 29 extends along the electric wire 17. In this way, the electric wire protecting part 29 extending from the sealing member 25 is interposed between the electric wire 17 and the shield member 16 at a position near the terminal joint part 23.

A plurality of terminal accommodating holes 32 are arranged in parallel in a rear end side of the housing 13, and the terminals 19 which are respectively jointed to the end portion of the electric wire 17 are inserted and accommodated in these terminal accommodating holes 32.

The housing 13 is provided at its front surface with a plurality of insertion holes 33, and the tap 21 of each terminal 19 which is inserted and accommodated in the terminal accommodating hole 32 is inserted in the insertion hole 33 to protrude forward from the housing 13.

The terminal accommodating hole 32 has a large-diameter portion 35A which is formed by increasing a rear end side of the housing 13 in diameter, and the sealing portion 27 of the sealing member 25 is fitted into the large-diameter portion 35. As the sealing portion 27 of the sealing member 25 is fitted into the large-diameter portion, the sealing member 25 seals between the housing 13 and the electric wire 17 at the rear end side of the housing 13.

A rear holder 37 is fitted into the large-diameter portion 35 of the housing 13 at a rear end side of the sealing member 25 rather than the sealing portion 27. The rear holder 37 is formed in a ring shape with a fitting hole 39 formed at its center, and the electric wire protecting part 29 of the sealing member 25 mounted on the electric wire 17 is fitted into the fitting hole 39 of the rear holder 37.

As the rear holder 37 is fitted into the large-diameter portion 35 of the housing 13, the sealing member 25 is pressed to prevent the sealing member 25 from being released from the housing 13.

The housing 13 is provided with a flange portion 41 on a circumference thereof. A sealing groove 43 is formed at a front side of the flange portion 41 in a circumferential direction, and a sealing ring 45 is mounted on the sealing groove 43.

The shield shell 15 is made of metal, such as aluminum or aluminum alloy, or a conductive material, so as to eliminate a noise. The shield shell 15 has a tubular portion 51 mounted to cover the housing 13, and a shell flange 53 formed at the front end side of the tubular portion 51. The shell flange 53 is provided with a concave portion 55 for receiving the flange portion 41 of the housing 13. Further, the shell flange 53 is provided with a bolt insertion hole 57.

The shield member 16 is made of a braid woven in a mesh shape from a plurality of thin metal wires, and has flexibility which is extendable in either of an axial direction or a radial direction. The shield member 16 is mounted so that one end side thereof covers the circumference of the tubular portion 51 of the shield shell 15. The shield member 16 is press-fastened and fixed to the shield shell 15 by a crimping ring 61 to electrically conduct with the shield shell 15. The shield member 16 is shaped to be gradually contracted toward its rear end side thereof, and the electric wires 17 led from the housing 13 and mounted with the electric wire protecting part 29 of the sealing member 25 are together enclosed by the shield member 16. Meanwhile, the shield member 16 is not limited to the braid, but may be a metal foil or a metal tube.

The connector 11A including the above structure is fixed to a case of an object to be connected, such as a motor, by inserting a bolt into the insertion hole 57 formed in the shell flange 53 of the shield shell 15 from the rear end side, and screwing the bolt to a threaded hole formed in the case of the object to be connected. The flange portion 41 of the housing 13 is pressed against the case of the object to be connected, and so that the housing 13 and the case of the object to be connected are sealed by the sealing ring 45 and the shield shell 15 is electrically connected to the case of the object to be connected.

By the way, if the electric wire 17 is pulled by an external force, such as shock, applied from an exterior and thus a tensile force is produced at the terminal joint part 23, the electric wire can be ruptured at the terminal joint part 23, or the sheath of the electric cable 17 can be peeled off.

In this instance, the connector 11A according to this embodiment can reliably prevent the short circuit which is caused by contact between the electric wire 17 and the shield member 16, since the electric wire 17 near the portion in which the electric wire 17 is joined with the terminal 19, that is, the terminal joint part 23, is covered and protected by the electric wire protecting part 29 of the sealing member 25 having the insulation property, and the electric wire protecting part 29 is interposed between the electric wire 17 and the shield member 16.

The length of the electric wire protecting part 29 is set in view of displacement of the connector, 11A which is fixed to the case of the object to be connected, due to the external force, and an extra length of the electric wire 17. For example, if a maximum displacement of the connector 11A is X and a minimum displacement absorbing quantity produced by the extra length of the electric wire 17 is Y, a section of a dimension X-Y from at least terminal joint part 23 is covered by the electric wire protecting part 29. Therefore, even though the electric wire is ruptured at the terminal joint part 23, it is possible to reliably prevent the short circuit due to the contact of the electric wire 17 and the shield member 16.

Further, since the electric wire protecting part 29 for preventing the short circuit is formed as a portion of the sealing member 25, as compared to the case of forming and employing a separate protecting member, it does not increase the number of components, which increases in cost.

Since the electric wire protecting part 29 is made of the waterproof resin which is a resilient material consisting of elastomer such as rubber, as compared to the case in which an electric wire protecting part is made of hard resin, it is possible to prevent the electric wire 17 without being damaged by the external force, such as shock, from the exterior, thereby reliably obtaining the effect of preventing the short circuit.

Only the electric wire protecting part 29 extends from the sealing member 25, and thus the number of components is not increased. Therefore, since it is not necessary to change manufacturing steps and man-hours when manufacturing, particular equipment can be easily provided at the time of production.

In this way, with the connector 11A according to this embodiment, it is possible to reliably prevent the short circuit, without causing increase in cost.

Second Embodiment

Next, a connector according to the second embodiment will be described.

Meanwhile, the same reference numerals have been used to identify the same or similar elements as those of the first embodiment, and the description thereof will be omitted herein.

Figure 6:
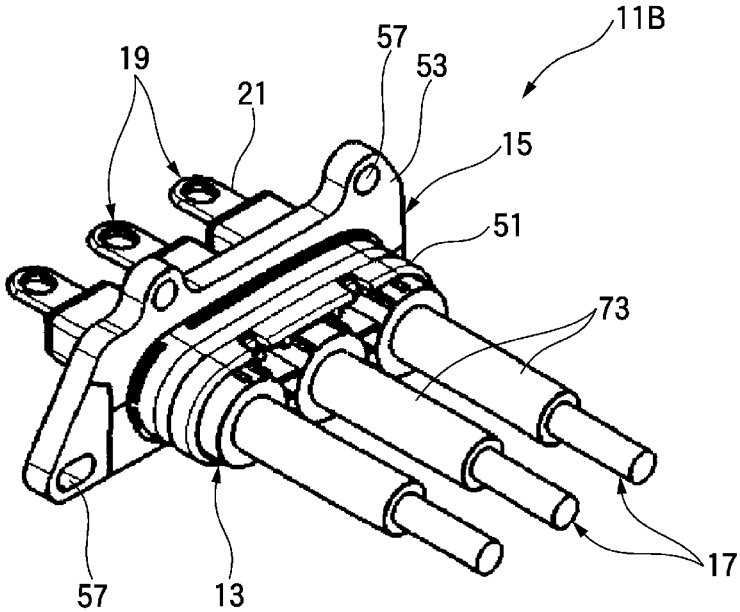
FIG. 6 is a perspective view illustrating a connector according to a second embodiment of the present invention, when seen from a rear side, in the state in which a shield member is detached.
Figure 7:
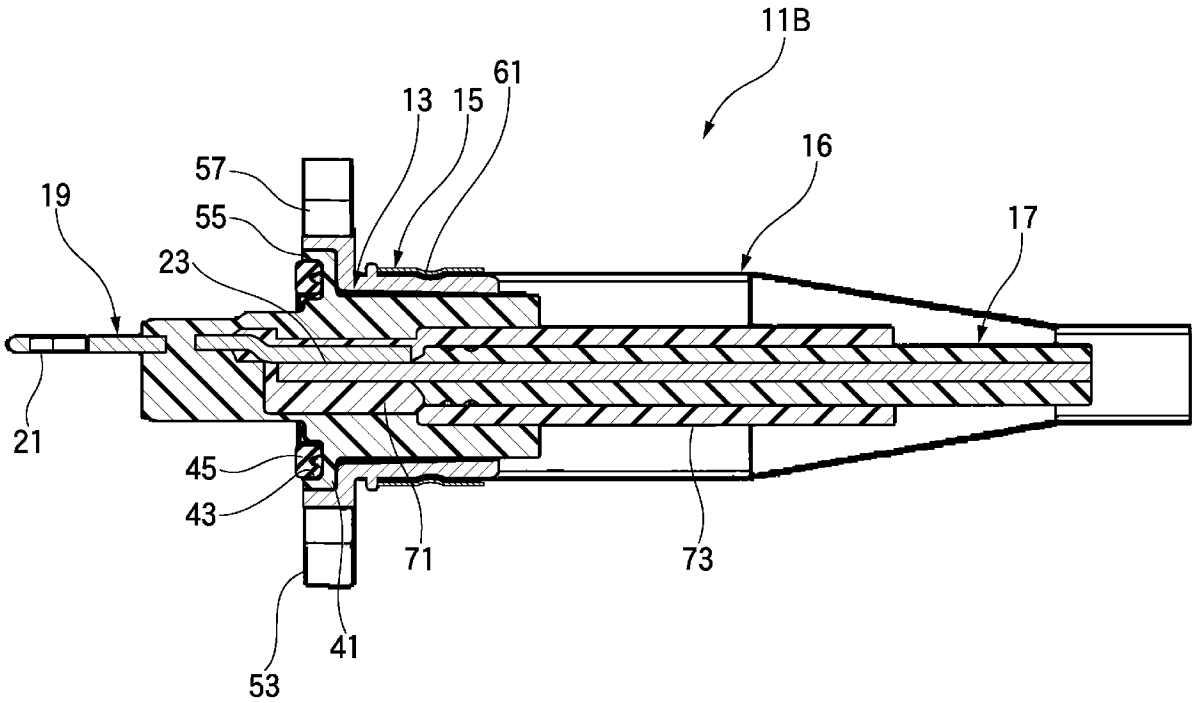
FIG. 7 is a cross-sectional view illustrating the connector according to the second embodiment of the present invention.
Figure 8:
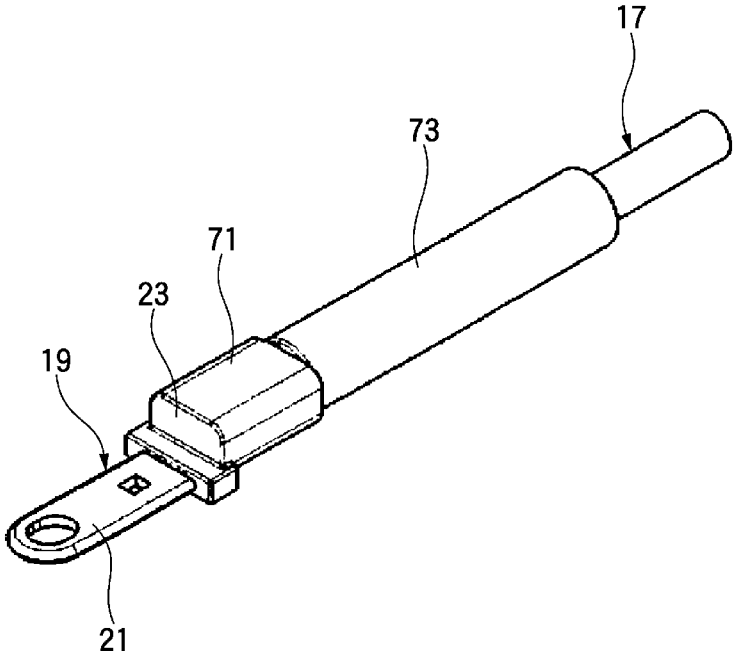
FIG. 8 is a perspective view illustrating an end portion of an electric wire which is connected to the connector.

FIG. 6 is a perspective view illustrating the connector according to the second embodiment of the present invention, when seen from a rear side, in the state in which a shield member is detached. FIG. 7 is a cross-sectional view illustrating the connector according to the second embodiment of the present invention. FIG. 8 is a perspective view illustrating an end portion of an electric wire which is connected to the connector.

As illustrated in FIGS. 6 to 8, a connector 11B according to the second embodiment includes a terminal joint part 23, which is a joint portion of an electric wire 17 and a terminal 19, molded from waterproof resin consisting of elastomer (elastic material) having insulation and waterproof properties, for example, rubber. A mold part 71 is formed integrally with an electric wire protecting part 73 extending from the electric wire 17 at a side opposite to the terminal 19. The vicinity of the terminal joint part 23 is covered by the electric wire protecting part 73. Also, the electric wire 17 is unified by disposing the mold part 71 and a portion of the electric wire protecting part 73 in a housing 13. In this way, a gap between the terminal joint part 23 and the housing 13 is sealed by the mold part 71. That is, the mold part 71 serves as a sealing member to seal between the terminal joint part 23 and the housing 13.

In the case of the connector 11B including the above structure, the electric wire 17 near the terminal joint part 23 is covered and protected by the electric wire protecting part 73 of the mold part 71 having the insulation property, and the electric wire protecting part 73 is interposed between the electric wire 17 and the shield member 16. Therefore, the connector 11B can reliably prevent the short circuit which is caused by contact between the electric wire 17 and the shield member 16 which is a conductor. Further, since the electric wire protecting part 29 for preventing the short circuit is formed as a portion of the mold part 71 which serves as the sealing member, it does not increase the number of components, which increases in cost, as compared to the case of forming and employing a separate protecting member.

Since the electric wire protecting part 73 is made of the resilient material, as compared to the case in which an electric wire protecting part is made of hard resin, it is possible to prevent the electric wire 17 without being damaged by the external force, such as shock, from the exterior, thereby reliably obtaining the effect of preventing the short circuit.

Only the electric wire protecting part 73 extends from the mold part 71 which serves as the sealing member, and thus the number of components is not increased. Therefore, since it is not necessary to change manufacturing steps and man-hours when manufacturing, particular equipment can be easily provided at the time of production.

In particular, since the electric wire protecting part 73 is molded integrally with the mold part 71, it is possible to decrease a cost by convenient manufacturing.

Incidentally, the present invention is not limited to the above-described embodiments, and a modification, a variation or the like is allowed. In addition, material, shape, size, number, location or the like of each component in the above-described embodiments are arbitrary and not limited as long as they can attain the present invention.

While the present invention has been described with respect to the specific embodiments, it will be apparent to those skilled in the art that various changes and modifications may be made without departing from the spirit and scope of the invention defined in the following claims.

This application claims priority to Japanese Patent Application No. 2011-010742, filed on Jan. 21, 2011, which is incorporated herein by reference in its entirety.

INDUSTRIAL APPLICABILITY

The present invention is useful for the technical field of the connector, since the short circuit can be reliably prevented without causing increase in cost.

DESCRIPTION OF REFERENCE NUMERALS

11A, 11B: connector
13: housing

15: shield shell
16: shield member
17: electric wire
19: terminal
23: terminal joint part
25: sealing member
29, 73: electric wire protecting part
71: mold part

The invention claimed is:

1. A connector comprising:

a terminal which is joined to an electric wire;

a housing which accommodates a terminal joint part which is a joint portion of the electric wire and the terminal;

a sealing member which is made of a resilient material having waterproof and insulation properties to seal between the housing and the terminal joint part; and a shield member which covers the housing and the electric wire near the terminal joint part, wherein the sealing member is formed integrally with an electric wire protecting part which extends beyond the housing along the electric wire to cover the electric wire, and wherein the electric wire protecting part is interposed between the electric wire and the shield member.

2. The connector according to claim 1, wherein the sealing member has a mold part for molding the terminal joint part, and the electric wire protecting part is molded integrally with the mold part.

* * * * *